US006302021B1

(12) United States Patent
Wadlinger

(10) Patent No.: US 6,302,021 B1
(45) Date of Patent: Oct. 16, 2001

(54) SHEET-FED PRINTING MACHINE

(75) Inventor: Ralf Wadlinger, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/419,691

(22) Filed: Oct. 14, 1999

(30) Foreign Application Priority Data

Oct. 14, 1998 (DE) ..... 298 18 343 U

(51) Int. Cl.[7] ..... B41F 13/24
(52) U.S. Cl. ..... 101/232; 101/216
(58) Field of Search ..... 101/183, 184, 101/185, 229, 230, 232, 216

(56) References Cited

U.S. PATENT DOCUMENTS 3,772,990 * 11/1973 Weisgerber ..... 101/230
4,295,421 * 10/1981 Abendroth et al. ..... 101/216

FOREIGN PATENT DOCUMENTS 43 18 777 C2 12/1994 (DE) .
297 10 252 U1 10/1997 (DE) .

* cited by examiner

*Primary Examiner*—Ren Yan
(74) *Attorney, Agent, or Firm*—Herbert L. Lerner; Laurence A. Greenberg; Werner H. Stemer

(57) ABSTRACT

A sheet-fed printing machine having an impression cylinder and a movable cylinder that can be thrown onto the impression cylinder and movable into a spaced position far removed from the impression cylinder, includes a sheet guide element assigned to the impression cylinder, the sheet guide element being movably mounted for guiding a printing-material sheet carried on the impression cylinder.

7 Claims, 1 Drawing Sheet

SHEET-FED PRINTING MACHINE

BACKGROUND OF THE INVENTION

FIELD OF THE INVENTION

The invention relates to a sheet-fed printing machine having an impression cylinder and a movable cylinder that can be thrown onto the impression cylinder and can be moved into a spaced position far removed from the impression cylinder.

A sheet-fed printing machine of this type is described in the published European Patent Document EP 0 477 283 B1. This sheet-fed printing machine has a withdrawable coating device with a coating cylinder which, in relation to an impression cylinder, can be moved into an operating position in order to coat the printing-material sheet resting on the impression cylinder, into a disengaged position at a slight distance from the impression cylinder, and into a position far removed from the impression cylinder and designated a second position.

A disadvantage of this sheet-fed printing machine is that when printing stiff printing-material sheets, for example, sheets made of heavy cardboard, without an in-line coating with the coating device, smearing of the yet-fresh printing ink is not ruled out. If in this case the coating cylinder were to remain in the disengaged position, the printing ink would be smeared onto the coating cylinder, and the printed image would be smeared due to this contact. If the inactive coating cylinder were to remain in the so-called second position, it would then be no longer possible to carry the trailing end of the sheet close to the impression cylinder, because of the inherent stiffness of the printing-material sheet, inasmuch as the coating cylinder located in the second position is no longer able to hold the printing-material sheet on the impression cylinder. The unstable position of the transported printing-material sheet would result in smearing of the printing ink onto other machine parts and possibly even to damage to the printing-material sheet.

The published German Patent Document DE 297 10 252 U1 contains a description of a guide device that is assigned to transfer drums and is provided with guide plates which can be pivoted and moved by pushing or sliding. Although this guide device can be used to carry stiff materials on the sheet transfer drums, and the transfer drums are easily accessible for maintenance and cleaning, the guide device is not suitable for use in conjunction with an impression cylinder and a cylinder that can be thrown onto the latter.

Furthermore, a sheet-fed printing machine that is not of the foregoing general type is described in the published German Patent Document DE 43 18 777 C2. This sheet-fed printing machine has a printing unit with a blanket cylinder and an impression cylinder. When the printing unit is not involved in printing, there is a spacing between the blanket cylinder and the impression cylinder that is about 2 mm distance and is therefore very small. The blanket cylinder of this inactive printing unit, that is located close to the impression cylinder of the unit, cannot be maintained or cleaned during printing with other printing units. One reason for this disadvantage is the poor accessibility of the blanket cylinder in the described operating situation of the printing machine. In addition, the use of two blast tubes or blower pipes arranged in the wedge-shaped space upline and downline of the printing zone is disadvantageous. Although the blast tubes permit a quiet sheet run in the case of thin sheets of paper, this cannot be achieved in the case of thick sheets of cardboard or pasteboard.

SUMMARY OF THE INVENTION

It is accordingly an object of the invention to provide an easily maintained sheet-fed printing machine wherein, in particular, stiff printing-material sheets can be conveyed without smearing and in a stable position through an inactive printing-machine unit of the printing machine.

With the foregoing and other objects in view, there is provided, in accordance with the invention, a sheet-fed printing machine having an impression cylinder and a movable cylinder that can be thrown onto the impression cylinder and movable into a spaced position far removed from the impression cylinder, comprising a sheet guide element assigned to the impression cylinder, the sheet guide element being movably mounted for guiding a printing-material sheet carried on the impression cylinder.

In accordance with another feature of the invention, the movable cylinder and the sheet guide element are selectively throwable onto the impression cylinder at substantially the same circumferential location on the impression cylinder.

In accordance with a further feature of the invention, the sheet guide element is pivotably mounted.

In accordance with an added feature of the invention, the sheet guide element is a sheet guide plate.

In accordance with an additional feature of the invention, the sheet guide element is selectively movable into a first position and into a second position, the sheet guide element, in the first position, extending through between the movable cylinder and a blower and, in the second position, being thrown onto the impression cylinder at a spaced distance therefrom.

In accordance with yet another feature of the invention, a minimum circumferential distance between the movable cylinder disposed in the spaced position and the impression cylinder is a plurality of decimeters.

In accordance with a concomitant feature of the invention, the printing machine includes a sheet transport drum for transferring a printing-material sheet to the impression cylinder, the printing-material sheet being carried by the sheet transport drum and being held at a leading edge thereof by grippers of the sheet transport drum, so that the printed-material sheet hangs down freely.

The sheet-fed printing machine having an impression cylinder and a movable cylinder that can be thrown onto the impression cylinder and can be moved into a spaced position far removed from the impression cylinder is distinguished by the fact that the impression cylinder has a sheet guide element assigned thereto, the sheet guide element being movably mounted for guiding a printing-material sheet carried on the impression cylinder.

The advantages of the invention manifest themselves in the operation of a printing machine which comprises a printing-machine unit and a further printing-machine unit arranged downstream of the latter, as viewed in the sheet transport direction, when, in a specific operating mode, for example, the operating mode of printing without in-line finishing, the printing-machine unit is active and the further printing-machine unit is inactive. The impression cylinder can be a constituent part of the further printing-machine unit, and the sheet guide element can be thrown onto the impression cylinder, so that the sheet guide element guides the printing-material sheet transported by the impression cylinder while the movable cylinder is located in the spaced position far removed from the impression cylinder. This permits the positionally stable and smear-free transport of the printing-material sheet freshly printed or coated in the printing-machine unit through the inactive further printing-machine unit and past the movable cylinder, while the movable cylinder can in the meantime be cleaned and maintained, for example.

The further printing-machine unit can be a so-called finishing unit of the sheet-fed printing machine, the unit being arranged downline of at least one printing unit and preferably a number of printing units. The term finishing unit is understood to mean, for example, a coating, impression, numbering, processing or cleaning unit. The further printing-machine unit may, however, also be a printing unit of a number of identical printing units, arranged in a row one after the other, of the sheet-fed printing machine.

The sheet-fed printing machine can be constructed as a sheet-fed rotary offset printing machine. In this case, the printing-machine unit can be one of a number of offset printing units and the further printing-machine unit can be a coating unit.

Other features which are considered as characteristic for the invention are set forth in the appended claims.

Although the invention is illustrated and described herein as embodied in a sheet-fed printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
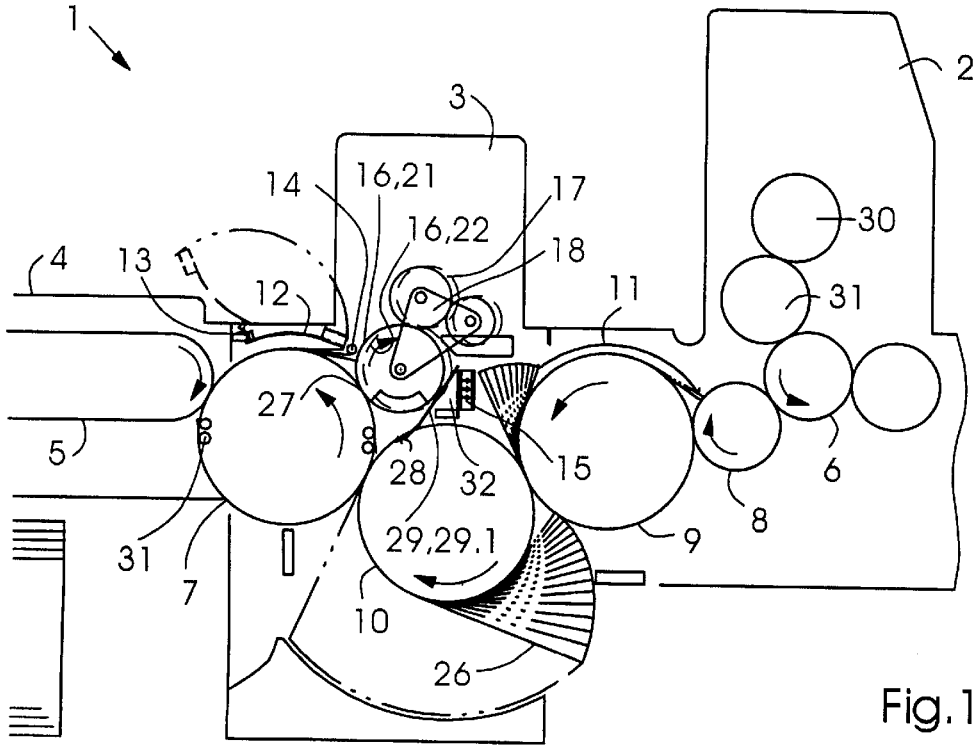
FIG. 1 is a fragmentary diagrammatic side elevational view of a printing printing machine with a printing-machine unit incorporated into the in-line process.

Referring now to the drawings and, first, particularly to FIG. 1 thereof, there is illustrated therein a sheet-fed printing machine 1 having at least two printing-machine units 2 and 3. The printing-machine unit 2 is a coating or printing unit, and the printing-machine unit 3 is a finishing unit arranged downline of the printing-machine unit 2, as viewed in the sheet transport direction. The finishing unit 3 can be a coating unit, a numbering or impression unit and a processing unit, for example for embossing or stamping the printing-material sheet 26. FIG. 1 illustrates a coating unit constructed as a varnishing unit 3, which is arranged downline of an offset printing unit 2. As viewed in the sheet transport direction, the offset printing unit 2 is the last printing unit of a number of identical non-illustrated printing units arranged in a row in the sheet-fed printing machine 1.

Figure 2:
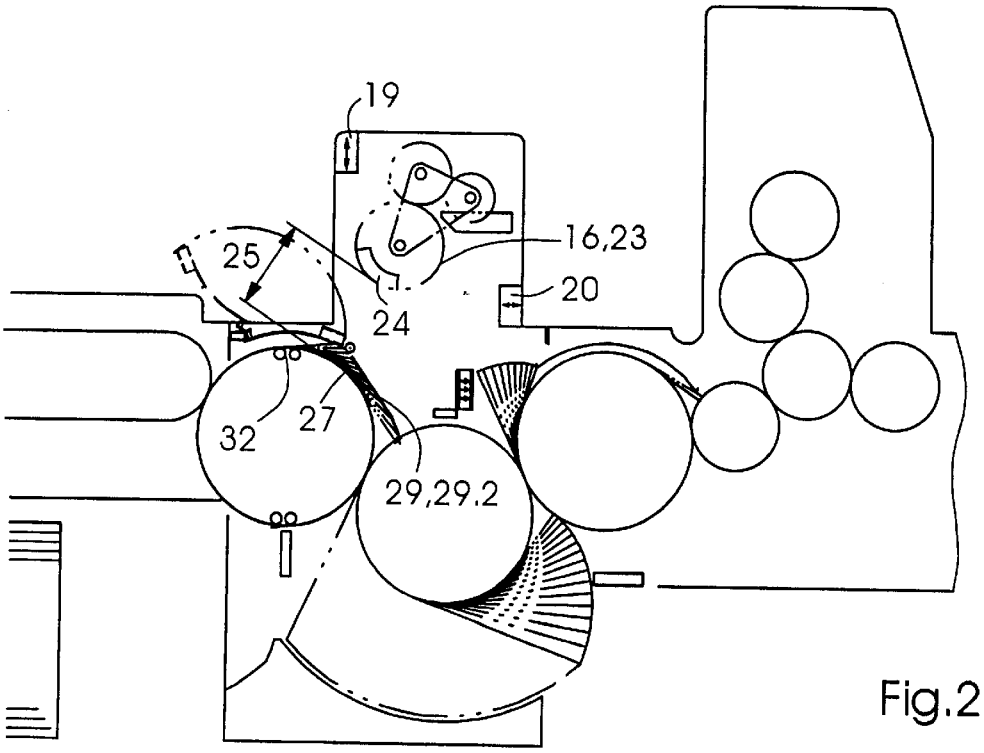
FIG. 2 is a view like that of FIG. 1 showing the printing printing machine with the printing-machine unit that is illustrated as not participating in the in-line process.

The printing-machine unit 3 includes an impression cylinder 7 and a movable cylinder 16 that can be moved into a thrown-on position 21 (active position) with operative contact with the impression cylinder 7 or the printing-material sheet 26 resting on the latter, into a spaced position 22 (neutral position) slightly removed from the impression cylinder 7 and having, for example, a 2-millimeter minimum circumferential spaced distance between the cylinders 7 and 16, and, as shown in FIG. 2, into a spaced position 23 (passive position) far removed from the impression cylinder 7, with a minimum circumferential distance 25 of at least a number of centimeters and preferably a number of tenths of a meter between the cylinders 7 and 16. In the active position 21, the illustrated movable cylinder 16 coats or varnishes the printing-material sheet 26 carried by the impression cylinder 7 and gripped by the grippers thereof. In the other possible embodiments of the printing-machine unit 3 mentioned hereinbefore, the movable cylinder 16 can be a cylinder that is printing or processing the printing-material sheet 26 and, for example, is fitted with tools. The neutral position 22 is comparable with the position which, in the case of printing cylinders, is usually referred to as print disengagement (impression throw-off). The passive position 23 (FIG. 2) is used for the maintenance or cleaning of the movable cylinder 16. For example, in this position, a cylinder cover that, in the example, is a varnishing plate or a varnishing blanket, can be replaced. A cylinder gap or channel 24 may accommodate within itself a retaining and tensioning device for fastening the cylinder cover. Grippers 32 of the impression cylinder 7 dip into the cylinder gap 24 as the cylinders 7 and 16 roll on one another. Furthermore, the printing-machine unit 3 has two adjusting or setting devices 19 and 20 illustrated only diagrammatically. Using the setting device 20, the cylinder 16 can be moved along a first direction of movement, for example, approximately horizontally, alternatively into the active position 21 and into the neutral position 22. Using the further setting device 19, the cylinder 16 can be moved along a second direction of movement that differs from the first direction of movement, for example, approximately vertically, alternatively into the passive position 23 and into the neutral position 22. The movable cylinder 16 is rotatably mounted in a carrier 18. The carrier 18 has two bearing plates which accommodate the cylinder 16 therebetween and are connected to one another, only the front plate of the two plates can be seen in FIGS. 1 and 2. Integrated in the carrier 18 is a feed device 17 for the metered feeding of a coating liquid to the cylinder 16. Instead of the coating liquid, the feed device 17 can also be used to feed a printing ink to the cylinder 16. The feed device 17 may include, for example, a dip roll for scooping the coating liquid out of a trough, and a metering roll for transferring the coating liquid from the dip roll to the cylinder 16. In the case wherein the cylinder 16 is not a printing cylinder or a coating cylinder either, but a cylinder processing the printing-material sheet 30, it is possible for at least one further cylinder or a further roll to be mounted so that it can rotate in the carrier 18, in addition to the cylinder 16. Together with the cylinder 16 and, if appropriate, together with at least one further cylinder, the carrier 18 forms a structural unit that can be moved into the positions 21 to 23 by the setting devices 19 and 20.

The sheet is transported from the impression cylinder 6 of the printing-machine unit 2 to the printing-machine unit 3, and through the latter, by the sheet transport drums 8 to 10 and by the impression cylinder 7, from which the printing-material sheets 26 are transferred to a chain gripper 5 of a sheet delivery 4 arranged downline of the printing-machine unit 3. Instead of the immediately following sheet deliver 4, the printing-machine unit 3 can be followed by at least one further printing-machine unit, for example, a further finishing unit, through which the printing-material sheets pass before they get to the sheet delivery 4. The two sheet transport drums 9 and 10 arranged upline of the impression cylinder 7 are constructed twice as large both in relation to the single-size cylinders 6, 30 and 31 and to the single-size sheet transport drum 8, and thus carry the printing-material sheets 26, held in the grip of the grippers thereof in a non-damaging manner with reduced bending.

On the upper side of the sheet transport drum 9, the latter has a sheet guide element 11 assigned thereto that is curved approximately equidistantly around the sheet transport drum 9. Furthermore, a blower 15 is used to hold the trailing section of the printing-material sheet 26 on the sheet transport drum 9 and at a distance from the sheet transport drum 10. This is advantageous particularly in that transport phase wherein the transported printing-material sheet 26 is no longer guided by the sheet guide element 11. In other embodiments of the sheet-fed printing machine 1, the blower 15 can also be assigned to a further impression cylinder, for example, of a printing unit arranged upline of the printing unit 3, instead of to the sheet transport drum 9. The sheet transport drum 10 is arranged between the sheet transport drum 9 and the impression cylinder 7. The sheet transport drum 9 and the impression cylinder 7 are arranged horizontally behind one another at the same height or level, and the sheet transport drum 10 is offset downwardly a distance approximately equal to the length of the radius of the sheet transport drum 9 or of the impression cylinder 7, so that a free space results above the sheet transport drum 10 and between the impression cylinder 7 and the sheet transport drum 9. Arranged in this space are the blower 15 and a movable sheet guide element 29, and the single-size cylinder 16 also dips partly into this space in the thrown-on position 22.

The blower 15 that is directed towards the sheet transport drum 9 or blows the printing-material sheet 26 against the latter, is made up of a number of air blowers which are arranged in a row parallel to the axis of the sheet transport drum 9, 10 and for which axial fans are preferably used. As an alternative to the air blowers, a blower pipe or blast tube can also be arranged extending parallel to the axis. In the region of a wedge-shaped sheet outlet gore that is formed by the cylinders 7 and 16 in the active position 21 and the neutral position 22, there is arranged a bar-like finger protection device that extends parallel to the axes of the cylinders 7 and 16 and close to the cylinder 16. Arranged above the impression cylinder 7 is a further sheet guide element 12 that is movably mounted and is constructed as a folding plate. When the sheet guide element 12 is folded up (broken line), the impression cylinder 7 is easily accessible, for example, for the purpose of cleaning. That end of the sheet guide element 12 which is located opposite the hinge 13 fixed to the frame is located close to the finger protection device 14 when the sheet guide element 12 is folded down. By contrast with the further sheet guide element 12, the sheet guide element 29 is not curved, i.e., is constructed essentially flat.

The functioning of the sheet-fed printing machine 1 is explained hereinbelow:

FIG. 1 illustrates the sheet-fed printing machine 1 operated in a first operating mode, the printing-material sheets 26, which may have been coated or, for example, printed in the printing-machine unit 2, being additionally printed, processed or, for example, coated in-line in the active printing-machine unit 3. For this purpose, the rotating, movable cylinder 16 is thrown onto the rotating impression cylinder 7, for example, so that the cylinder 16 can apply a varnish layer to the printing-material sheet 26 transported on the impression cylinder 7. The circumferential point 27 corresponds to the region of the throw-on point of the cylinder 16 onto the impression cylinder 7 and is an ideal physical reference point that does not rotate with the impression cylinder 7 and that, in the case of a cylinder 16 formed as a printing cylinder, can usually be referred to as the printing zone. The movable sheet guide element 29 is thrown off the impression cylinder 7 in this first operating mode and, in the position 29.1 which is comparatively remote from the impression cylinder 7, extends between the movable cylinder 16 and the blower 15. An open intake side of the blower 15, which faces the sheet guide element 29 (constructed as a substantially complete plate), and the sheet guide element 29 located in the position 29.1 remote from the impression cylinder 7, enclose an intake space 32 that is wedge-shaped and open at the ends. The sheet guide element 29 extends over the entire length of the cylinder 16, as viewed in the axial direction of the latter, and forms a cover shielding the cylinder 16 from the action of the blower 15. This is particularly advantageous if the cylinder 16 is a printing or coating cylinder that carries the printing ink or coating liquid on the outer circumferential surface thereof. The shielding formed by the sheet guide element 29 prevents the ambient air from around the cylinder 16 from being taken in by the blower 15, and further prevents the drying out or evaporation of the liquid film applied to the cylinder 16. The risk of such drying out exists in particular when the intake side of the blower 15, facing the cylinder 16, is located comparatively close to the cylinder 16, as shown. The sheet guide element 29 that is pivotable about the hinge 28 and is located in the position 29.1, can be supported on the blower 15, for example, by resting on the upper edge of the blower 15.

FIG. 2 illustrates a second operating mode of the sheet-fed printing machine 1. In this case, although the printing-material sheets 26 are printed or possibly coated in the printing-machine unit 2 and, if appropriate, in further printing-machine units which are arranged upline of the printing-machine unit 2, as viewed in the sheet transport direction, but are not illustrated, the printing-material sheets 26 pass through the inactive printing-machine unit 3 without any action from the cylinder 16 moved into the passive position 23, i.e., in the example, without any additional varnish coating being applied to the printed printing-material sheets 26. The distance 25 between the movable cylinder 16 and the impression cylinder 7 is, for example, 30 centimeters, so that the cylinder 16 is easily accessible for maintenance purposes during the operation of the sheet-fed printing machine 1. Smearing on the cylinder 16 of the printing-material sheets 26 transported past the cylinder 16 located in the passive position 23 is ruled out, because the position of the cylinder 16 is far removed from the impression cylinder 7. However, stabilization of the sheet transport of printing-material sheets 26 which are no longer held on the impression cylinder 7 by the movable cylinder 16 in the corresponding circumferential region is desirable, the intention also being to prevent the printing-material sheets 26 from smearing on other machine parts close to the impression cylinder 7, for example, the finger protection device 14. According to the invention, for this purpose, the movable sheet guide element 29 can be thrown onto the impression cylinder 7, i.e., can be moved into a position 29.2 which is comparatively close to the impression cylinder 7, for example, by being pivoted about the hinge 28. That end of the sheet guide element 29 which is located opposite to the hinge 28 fixed to the frame is located close to the finger protection device 14 when the sheet guide element 29 is moved into the position 29.2.

Advantageously, the sheet guide element 29 can virtually assume the place of the movable cylinder 16 on the impression cylinder 7. Of course, in the process, a space must be maintained between the sheet guide element 29 and the impression cylinder 7, through which space the printing-material sheets 26 can be conveyed in a stable position and without smearing. An edge strip that normally remains nonprinted on the trailing end of the printing-material sheet 26 can strike or slide along the insides of the sheet guide elements 12 and 29 and the finger protection device 14 without any damaging effect during the sheet transport. It is particularly beneficial in production terms that the sheet guide element 29 which, like the movable cylinder 16, can be thrown onto the impression cylinder 7 in the region of the first quadrant, extends over the circumferential point 27 in a direction that is parallel to the tangential line when it is in the thrown-on position 29.2 thereof. The sheet guide plate can also be formed curved approximately equidistantly from the circumferential surface of the impression cylinder 7.

I claim:

1. A sheet-fed printing machine, comprising:

an impression cylinder having a circumference;

a movable cylinder that can be thrown onto the impression cylinder at a reference location adjacent the circumference of the impression cylinder and movable into a spaced position far removed from the impression cylinder; and a sheet guide element assigned to the impression cylinder, said sheet guide element being movably mounted for guiding a printing-material sheet carried on the impression cylinder;

when said moveable cylinder is moved into the spaced position, said sheet guide element is selectively throwable onto the impression cylinder substantially at the reference location adjacent the circumference of the impression cylinder.

2. The printing machine according to claim 1, wherein said sheet guide element is pivotably mounted.

3. The printing machine according to claim 1, wherein said sheet guide element is a sheet guide plate.

4. The printing machine according to claim 1, wherein said sheet guide element is selectively movable into a first position and into a second position, said sheet guide element, in said first position, extending through between the movable cylinder and a blower and, in said second position, being thrown onto the impression cylinder at a spaced distance therefrom.

5. The printing machine according to claim 1, wherein a minimum circumferential distance between the movable cylinder disposed in the spaced position and the impression cylinder is a plurality of decimeters.

6. The printing machine according to claim 1, including a sheet transport drum for transferring a printing-material sheet to the impression cylinder, the printing-material sheet being carried by said sheet transport drum and being held at a leading edge thereof by grippers of said sheet transport drum, so that the printed-material sheet hangs down freely.

7. A sheet-fed printing machine, comprising:

an impression cylinder having a circumference;

a movable cylinder that can be thrown onto the impression cylinder at a reference location adjacent the circumference of the impression cylinder and movable into a spaced position far removed from the impression cylinder; and a sheet guide element assigned to the impression cylinder, said sheet guide element being movably mounted for guiding a printing-material sheet carried on the impression cylinder;

said sheet guide element, as viewed in a sheet transport direction, extending over the reference location adjacent the circumference of the impression cylinder.

* * * * *